US006585185B1

(12) United States Patent
Weiss et al.

(10) Patent No.: US 6,585,185 B1
(45) Date of Patent: Jul. 1, 2003

(54) MULTIPLE OUTPUT REEL MODULE

(75) Inventors: Martin Weiss, Penang (MY); Merlin Behnke, Grafton, WI (US); Scott E. Booker, Oconomowoc, WI (US); David J. Rollmann, New Berlin, WI (US); Troy R. Beasley, West Allis, WI (US); Kenneth J. Pikus, Franklin, WI (US)

(73) Assignee: Robotic Vision Systems, Inc., Canton, MA (US)

( * ) Notice: Subject to any disclaimer, the term of this patent is extended or adjusted under 35 U.S.C. 154(b) by 0 days.

(21) Appl. No.: 09/900,757

(22) Filed: Jul. 6, 2001

(Under 37 CFR 1.47)

Related U.S. Application Data

(60) Provisional application No. 60/216,612, filed on Jul. 7, 2000, and provisional application No. 60/217,188, filed on Jul. 10, 2000.

(51) Int. Cl.[7] ..... B65H 19/26; B65H 19/28; B65H 19/30

(52) U.S. Cl. ..... 242/527.7; 242/532.5; 242/533.5; 242/533.6

(58) Field of Search ..... 242/533.4, 533.5, 242/533.6, 527.5, 532.5, 527.7

(56) References Cited

U.S. PATENT DOCUMENTS

| | | | | | |
|---|---|---|---|---|---|
| 3,297,272 | A | | 1/1967 | Dekker | |
| 3,514,046 | A | * | 5/1970 | Stockdale et al. | 242/533.6 |
| RE28,353 | E | * | 3/1975 | Nystrand et al. | 242/533.4 |
| 3,930,620 | A | * | 1/1976 | Taitel | 242/533.6 |
| 4,147,310 | A | * | 4/1979 | Harden et al. | 242/533.4 |
| 4,846,416 | A | * | 7/1989 | Natale | 242/533.5 |
| 4,964,585 | A | | 10/1990 | Negrussi | |
| 5,031,849 | A | | 7/1991 | Grossi | |
| 5,069,394 | A | | 12/1991 | Panttila et al. | |
| 5,190,232 | A | * | 3/1993 | Brandon et al. | 242/533.4 |
| 5,803,395 | A | * | 9/1998 | Tanaka et al. | 242/532.5 |
| 5,810,280 | A | * | 9/1998 | Ryan et al. | 242/533.6 |
| 5,913,490 | A | * | 6/1999 | McNeil et al. | 242/533.4 |
| 6,230,998 | B1 | * | 5/2001 | Winkel | 242/527.7 |
| 6,425,547 | B1 | * | 7/2002 | Singh | 242/533.4 |

* cited by examiner

*Primary Examiner*—John M. Jillions
(74) *Attorney, Agent, or Firm*—Michael Best & Friedrich LLP

(57) ABSTRACT

A multiple output reel module includes a reel wheel supporting a plurality of spindles. Mounted to each spindle is a reel. The reel wheel is rotatable to position one of the spindle and reel combinations in a loading position in which output media from a nearby machine is interconnected to the reel. The spindle and reel are rotated to load the reel with output media. A CPU monitors the status of the reel, and stops the loading when the reel is full. The CPU then rotates the reel wheel to position a second spindle and reel combination in the loading position. The output media is automatically positioned over a portion of the second reel, and the output media is automatically interconnected to the second reel with an over-center finger assembly. Then the output media between the two reels is cut and the second reel is loaded with output media.

19 Claims, 16 Drawing Sheets

MULTIPLE OUTPUT REEL MODULE

This application claims the benefit of prior filed co-pending provisional patent application Ser. No. 60/216,612 filed on Jul. 7, 2000 and provisional patent application Ser. No. 60/217,188 filed Jul. 10, 2000, now abandoned.

BACKGROUND

The invention relates to an output reel module for use with taper apparatus for packaging computer chips.

SUMMARY

The present invention provides a multiple output reel module for use with a device that produces a flexible output media. The module includes a base, first and second spindles supported by the base, a reel mounted onto each of the first and second spindles for rotation therewith, and a mechanism for moving the first and second spindles into and out of a loading position. The module also includes an attachment mechanism attaching the output media to the spindles that is in the loading position. The module also includes a reel motor selectively rotating the spindles that is in the loading position, such that the output media is loaded onto the reel in the loading position.

Once the reel on the first spindle is loaded, the module automatically actuates the mechanism for moving the spindles, and moves the first spindle out of the loading position and the second spindle into the loading position. The attachment mechanism automatically attaches the output media to the reel on the second spindle when the second spindle is in the loading position, and the reel motor automatically loads the reel on the second spindle with output media after the output media is attached to the reel.

The module may also include a cutting mechanism for cutting the output media between the reels on the first and second spindles prior to loading the reel on the second spindle with output media. The module permits the automatic loading of a second reel of output media while an operator sees to replacing the full reel on the first spindle with an empty reel.

Other features and advantages of the invention will become apparent to those skilled in the art upon review of the following detailed description, claims, and drawings.

Figure 1:
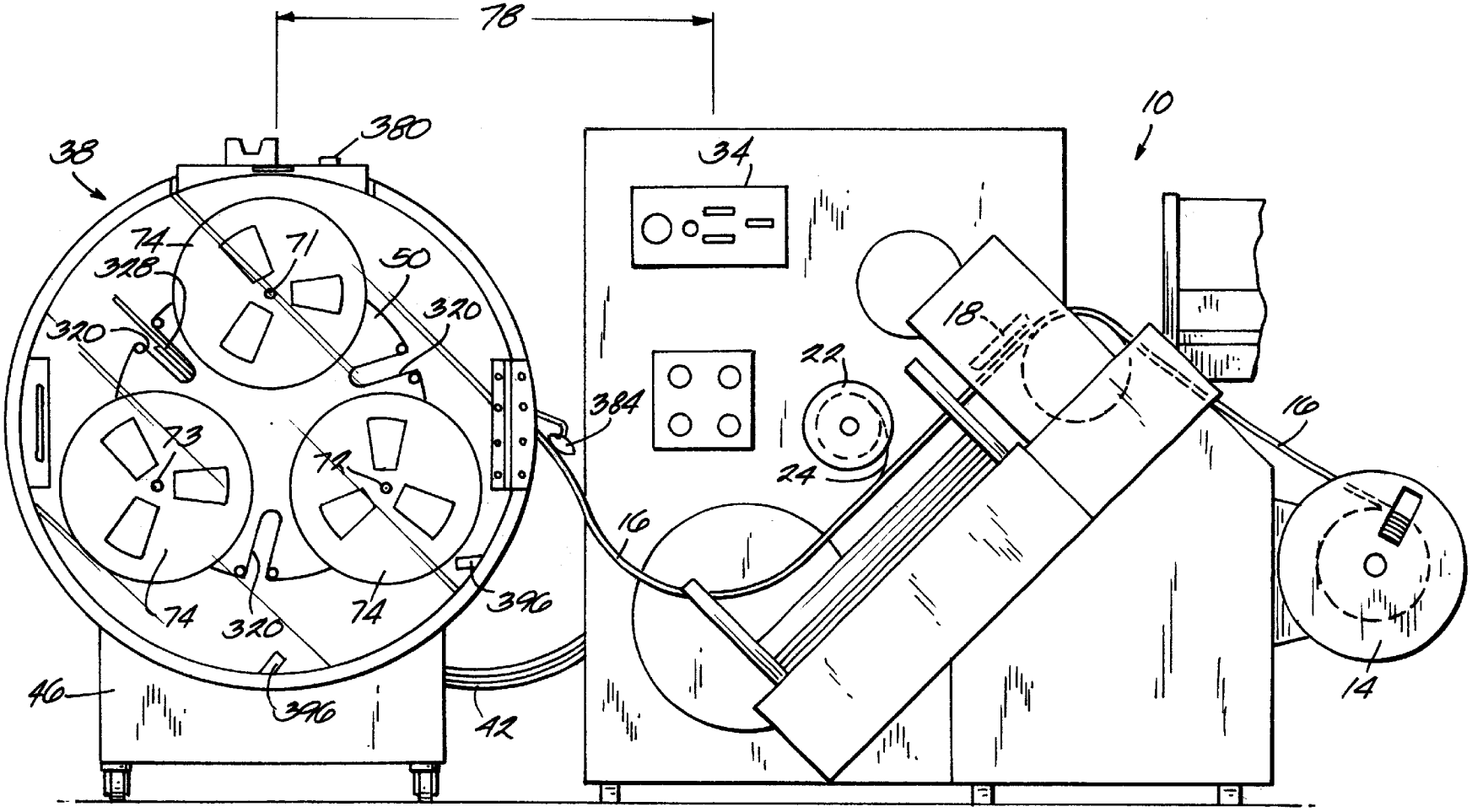
FIG. 1 is a front view of a multiple output reel module ("MROM") embodying the present invention and used in conjunction with a taper machine.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items. The use of "consisting of" and variations thereof herein is meant to encompass only the items listed thereafter. The use of letters to identify elements of a method or process is simply for identification and is not meant to indicate that the elements should be performed in a particular order.

DETAILED DESCRIPTION

Figure 15:
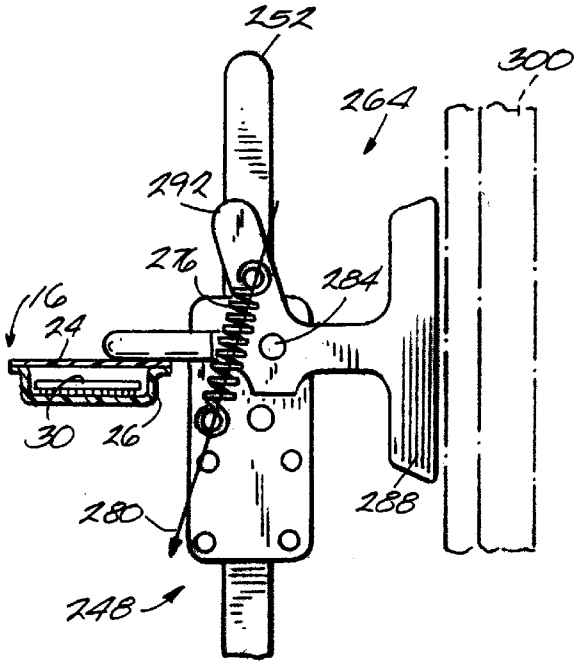
FIG. 15 is a side view of the finger assembly in a middle position.

FIG. 1 illustrates a taper machine 10 that includes a reel 14 of carrier tape 16, an inspection device 18, and a reel 22 of cover tape 24 (FIG. 15). The carrier tape 16 includes recessed pockets or compartments 26 (FIG. 15). The taper machine 10 inspects electronic components or parts 30 (FIG. 15) with the inspection device 18, and then deposits the parts 30 into the compartments 26 of the carrier tape 16. The taper machine 10 also affixes the cover tape 24 to the carrier tape 16 such that the compartments 26 are sealed by the cover tape 24, with the parts 30 trapped in the compartments 26. The taper machine 10 includes a central processing unit ("CPU") 34 that controls the operation of the taper machine 10. It should be noted that, although a taper machine 10 is illustrated, the invention may be used with virtually any machine that outputs a flexible media (e.g., tape, film, rope, cable, etc.) that is to be wound onto reels or spools.

Figure 2:
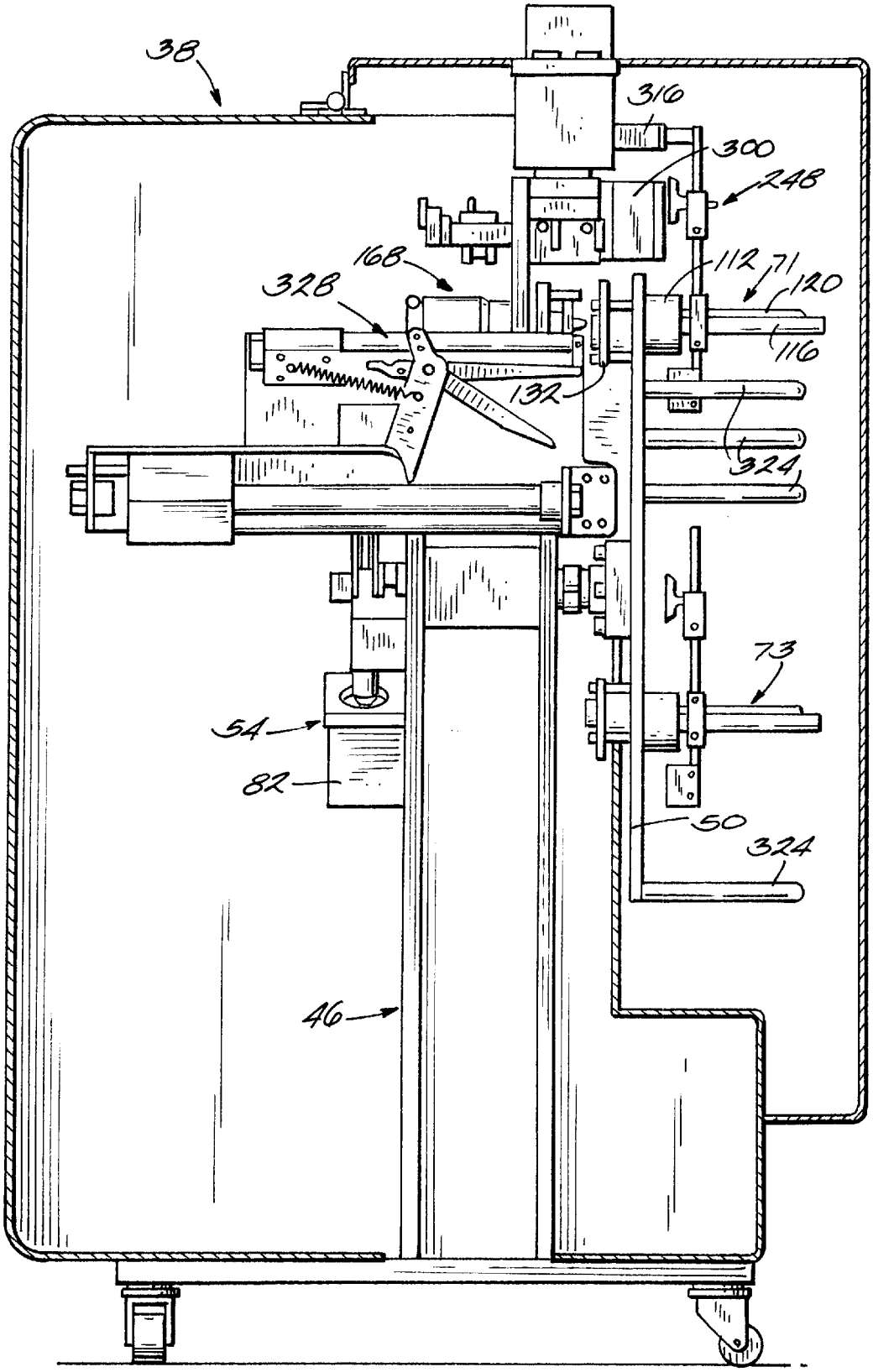
FIG. 2 is a side view of the MROM of FIG. 1.
Figure 3:
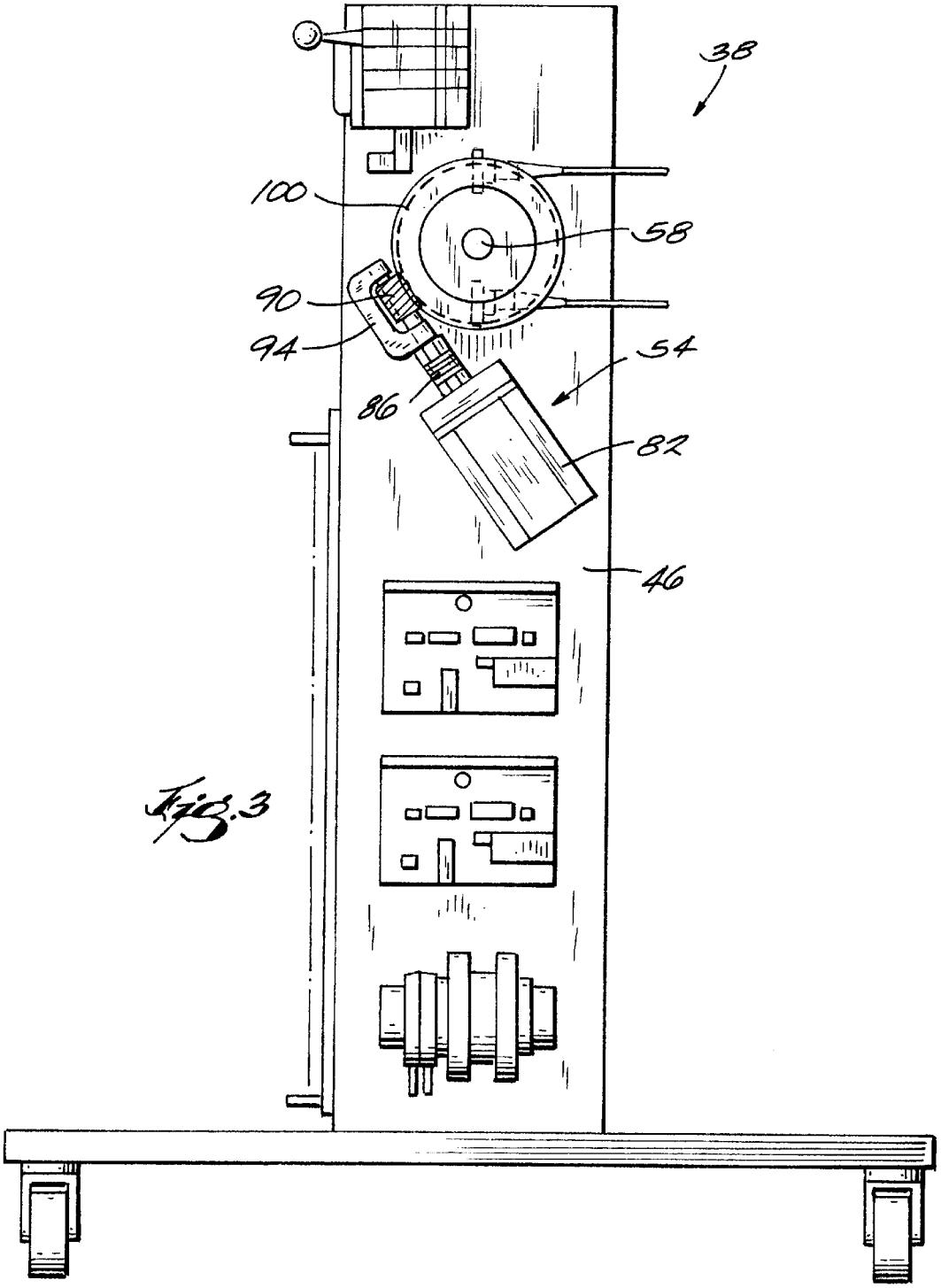
FIG. 3 is a rear view of the MROM of FIG. 1.

FIGS. 1–3 illustrate a multiple output reel module ("MROM") 38 embodying the invention. Wires 42 interconnect the MROM 38 to the CPU 34 on the taper machine 10 in the illustrated construction to coordinate operation of the MROM 38 and taper machine 10. In alternative constructions, a separate CPU may be mounted on-board the MROM 38, and may communicate with the CPU 34 aboard the taper machine 10. Additionally, the MROM 38 may be used with other types of taper machines 10 than the one illustrated, and may receive the flexible media from either the right side (as illustrated) or from the left side. In the event the flexible media is fed to the MROM 38 from the left side, the arrangement of parts would be a substantial mirror image of that shown. The MROM 38 includes a system base or pillar 46, a reel wheel or trunnion 50 rotatably mounted to the base 46, and a wheel drive assembly 54 mounted to the base 46.

Figure 5:
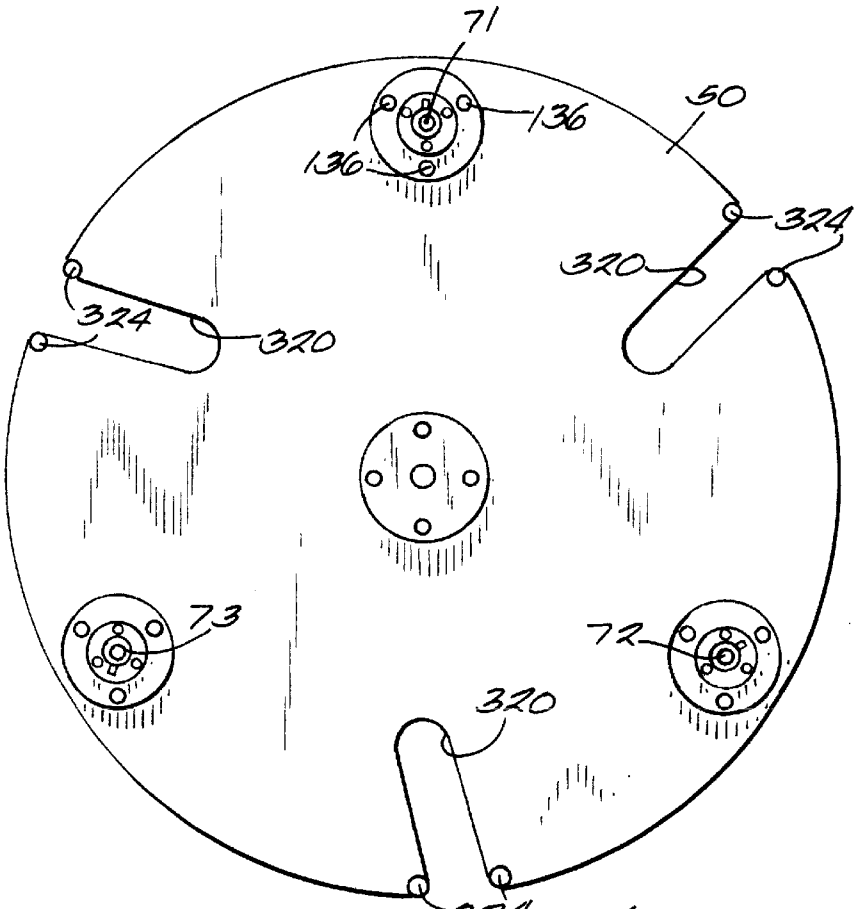
FIG. 5 is a front view of the reel wheel of the MROM.
Figure 4:
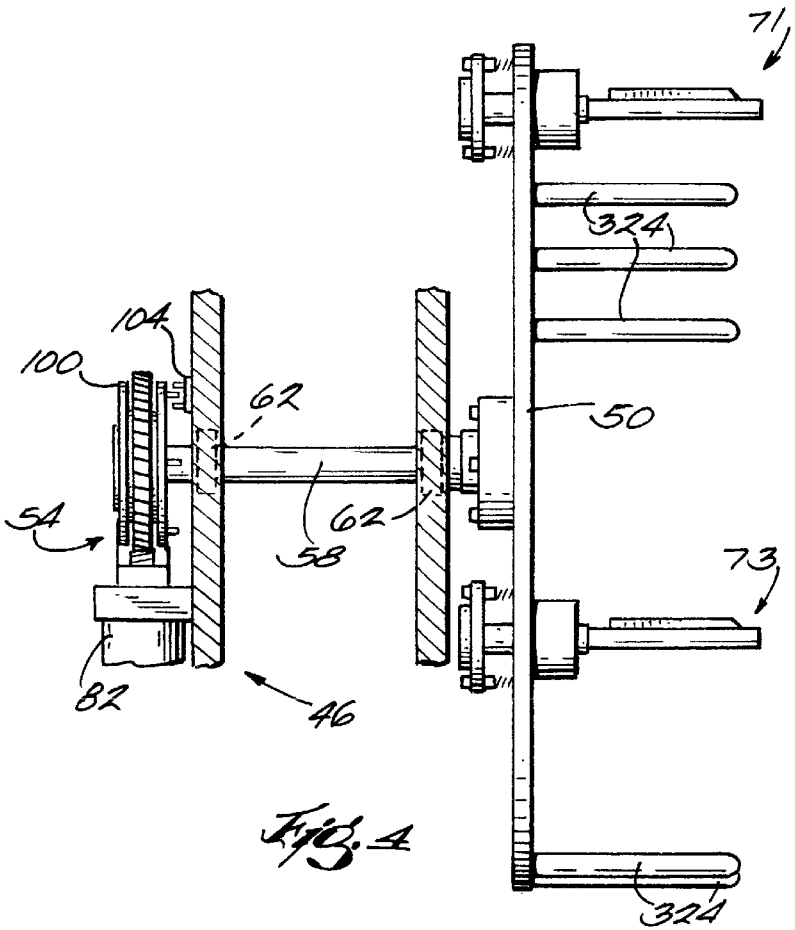
FIG. 4 is a side view of the reel wheel of the MROM.
Figure 7:
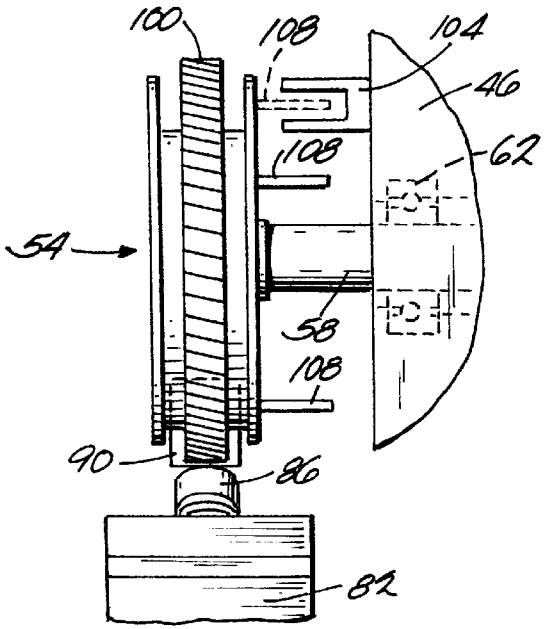
FIG. 7 is a side view of the wheel motor and gear.
Figure 6:
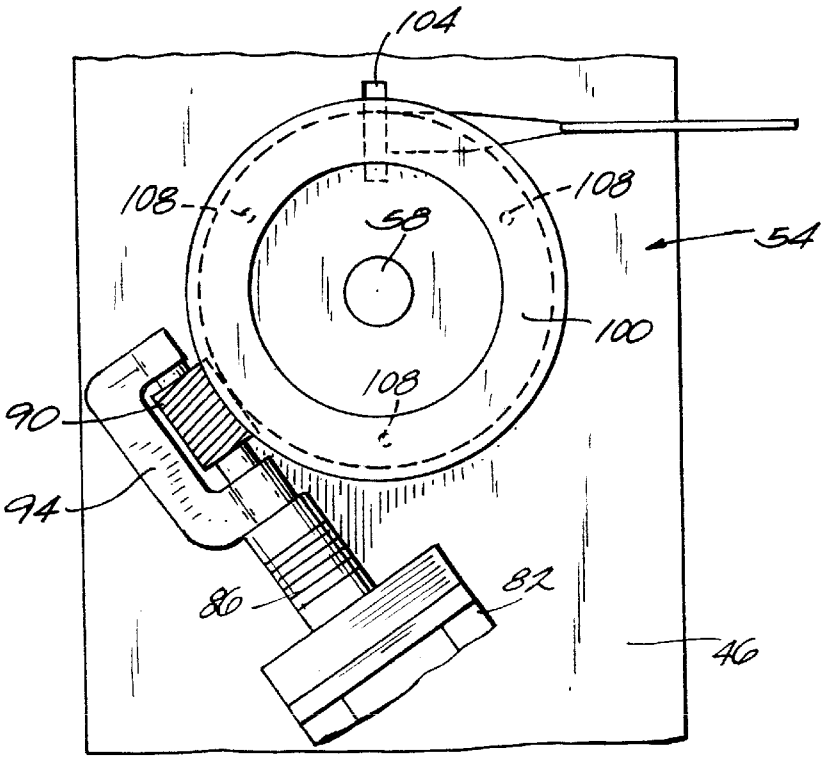
FIG. 6 is an enlarged view of the wheel motor and gear of the MROM.

With reference to FIGS. 4 and 5, the wheel 50 includes an axle 58 that is supported for rotation by two bearings 62 in the base 46. The wheel 50 supports first, second, and third spindle assemblies 71, 72, 73. The spindle assemblies 71, 72, 73 are spaced around the wheel 50 in 120° increments. It should be noted that although the illustrated embodiment includes three spindle assemblies, the wheel 50 may carry as few as two or more than three spindle assemblies. Each spindle assembly 71, 72, 73 supports a reel 74 as will be discussed in more detail below. In FIG. 4, the first spindle 71 assembly is in a loading position, the second spindle assembly 72 is in an on-deck position, and the third spindle assembly 73 is in a change-out position. The spindle assembly in the loading position is spaced from the output of the taper machine 10 a pocket offset distance 78. The CPU 34 is programmed with the pocket offset distance 78 (FIG. 1), the significance of which will be discussed below.

As seen in FIGS. 3–7, the wheel drive assembly 54 includes a wheel motor 82 mounted to the base 46 and having an output shaft 86. A worm gear 90 is coupled to the output shaft 86 and is rotatable therewith in response to operation of the wheel motor 82. A worm gear support block 94 supports the worm gear 90 at each end. A gear/sensor plate assembly 100 is mounted to the wheel's axle 58, and meshes with the worm gear 90 such that operation of the wheel motor 82 causes rotation of the wheel 50 through the worm gear 90 and gear/sensor plate assembly 100.

The wheel motor 82 is operable in forward and backward directions to cause counterclockwise and clockwise rotation (as seen in FIG. 1), respectively, of the wheel 50. A forked interrupt sensor 104 is mounted to the base 46, and three detector pins 108 are mounted to the gear/sensor plate assembly 100 at 120° increments. When one of the detector pins 108 is positioned between the arms of the forked sensor 104, a corresponding one of the spindle assemblies 71, 72, 73 is positioned in the loading position. Both the wheel motor 82 and the interrupt sensor 104 are wired to the CPU 34 so that the CPU 34 is informed of the presence of a detector pin 108 within the interrupt sensor 104.

Figure 8:
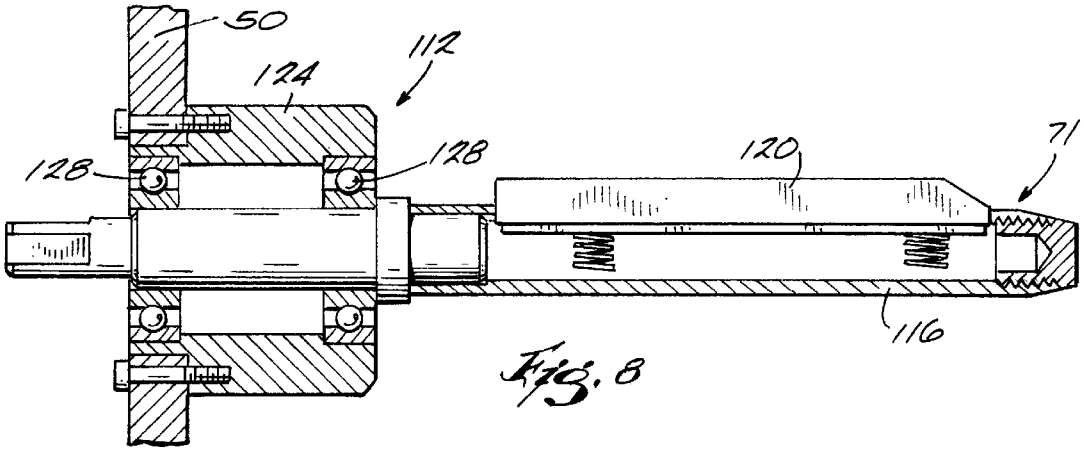
FIG. 8 is a section view of one of the spindle assemblies of the MROM.

Referring to FIG. 8, the first spindle assembly 71 will be described, it being understood that the second and third spindle assemblies 72, 73 are substantially identical to the first spindle assembly 71. The spindle assembly 71 includes a bearing assembly 112, a spindle 116, and a key 120. The bearing assembly 112 includes a housing 124 mounted to the wheel 50 and supporting two bearings 128. The spindle 116 extends through the bearing assembly 112 and is supported by the bearings 128 in cantilever fashion for rotation with respect to the wheel 50. The spindle 116 includes an outer end and an inner end on opposite sides of the wheel 50. The key 120 is supported by the outer end of the spindle 116 and is biased by springs to an extended position (illustrated in FIG. 8). The key 120 rotationally couples a reel 74 to the spindle 116 (as will be further discussed below), while still allowing for the quick change-out of one reel 74 for another on the spindle 116.

Figure 9:
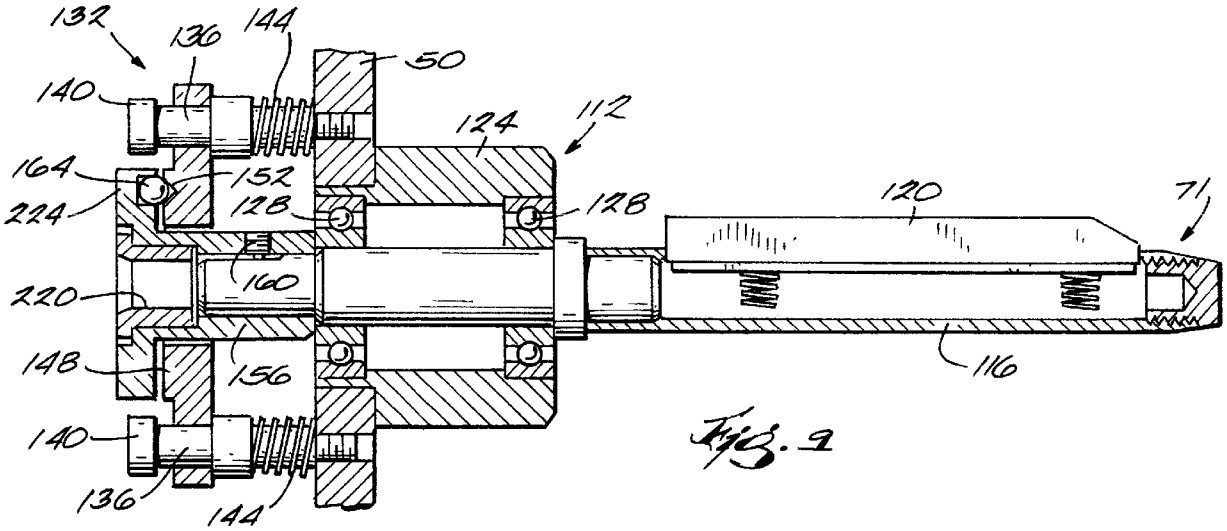
FIG. 9 is a section view of the spindle assembly with a detent mechanism.

Referring now to FIG. 9, the inner end of the spindle 116 extends through a hole in the wheel 50, and is coupled to a detent assembly 132. The detent assembly 132 includes three or more bolts 136 threaded into the wheel 50 and having bolt heads 140, a compression spring 144 surrounding each bolt 136, and a brake plate 148 captured between the bolt heads 140 and the springs 144 such that the springs 144 bias the brake plate 148 against the bolt heads 140. The brake plate 148 includes three detents or depressions 152 spaced 120° from each other. The detent assembly 132 also includes a brake hub 156 that is affixed to the inner end of the spindle 116 with a set screw 160 or other suitable fastener so that the brake hub 156 and spindle 116 rotate together. The brake hub 156 extends through the brake plate 148 and has a flange extending generally parallel to the brake plate 148. Three ball bearings 164 are housed in the flange of the brake hub 156 at 120° increments and are sandwiched between the brake hub 156 flange and the brake plate 148. The ball bearings 164 are aligned with the detents 152 such that the detent assembly 132 resists rotation of the spindle 116 when the ball bearings 164 are captured in the detents 152.

Figure 10:
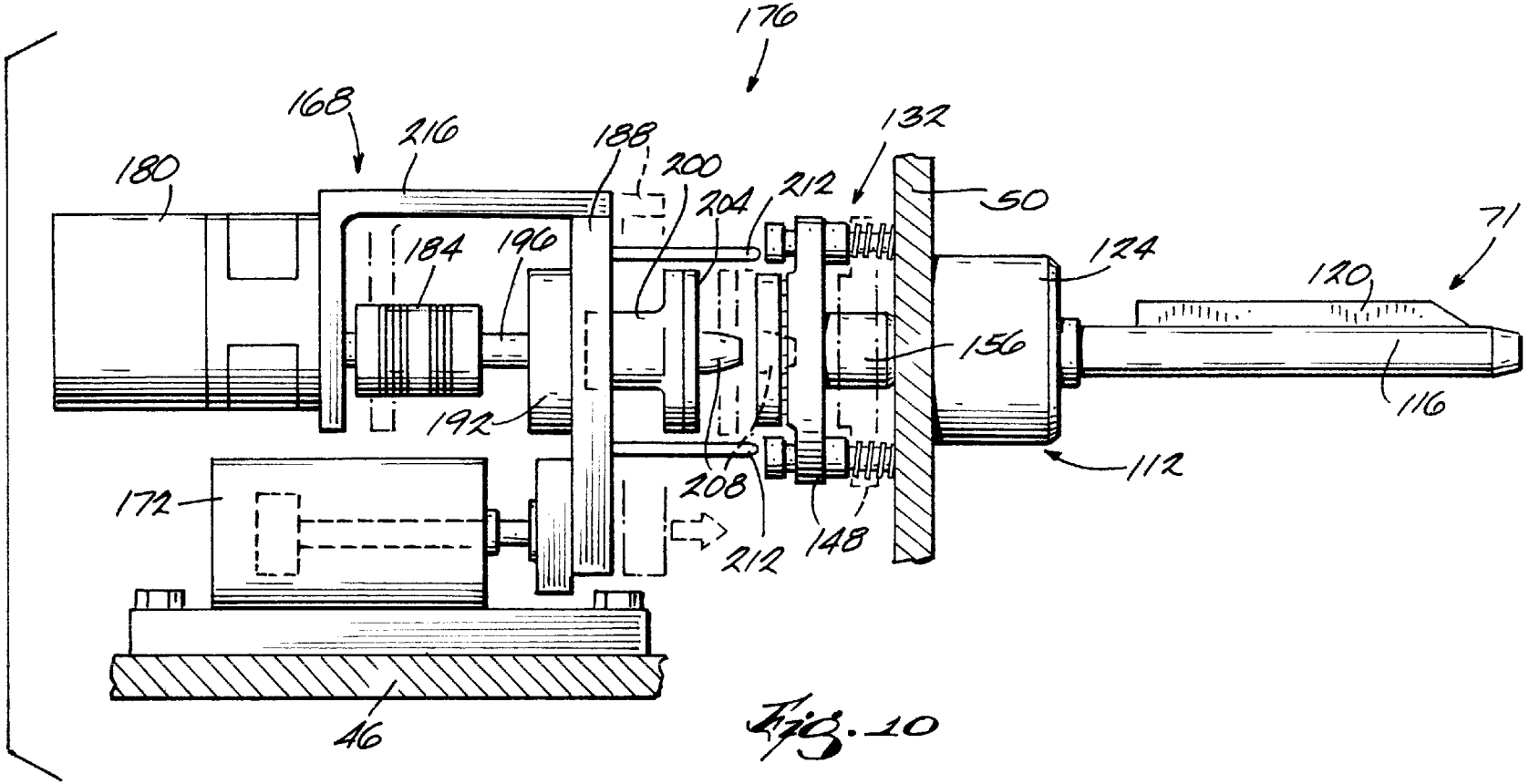
FIG. 10 is a side view of the reel drive assembly of the MROM.

Referring to FIG. 10, the MROM 38 has a reel drive assembly 168 that includes a reel motor actuator 172 (e.g., a pneumatic actuator or other suitable actuator) mounted to the base 46. The reel motor actuator 172 includes a piston rod that is linearly actuable. The reel drive assembly 168 also includes a drive hub assembly 176, a reel motor 180, and a flexible coupling 184. The drive hub assembly 176 includes a substantially vertical plate 188, a radial bearing assembly 192, a drive shaft 196, a drive hub 200, a rubber ring pad 204, a bullet nose dowel 208 constructed of hardened steel, and three deflector pins 212. The radial bearing assembly 192 is mounted to the vertical plate 188 and supports the drive shaft 196 for rotation. The drive hub 200 is rotationally fixed to the drive shaft 196 with a set screw or other suitable fastener. The rubber ring pad 204 is mounted to the face of the drive hub 200 and encircles the bullet nose dowel 208. The deflector pins 212 extend from the vertical plate 188 alongside the drive hub 200.

An L-shaped bracket 216 is mounted to the vertical plate 188. The reel motor 180 is mounted to the downwardly extending portion of the L-shaped bracket 216. An output shaft of the reel motor 216 extends through a hole in the L-shaped bracket 216 and rotates in response to operation of the reel motor 180. The reel motor 180 is interconnected with and controlled by the CPU 34. The flexible coupling 184 interconnects the reel motor output shaft and the drive shaft 196 such that the drive shaft 196 and drive hub 200 rotate together in response to operation of the reel motor 180.

The reel drive assembly 168 also includes a hardened steel bushing 220 (FIG. 9) inside the brake hub 156 and fixed for rotation therewith. The brake hub 156 also includes a machined face 224 surrounding the bushing 220. The reel drive assembly 168 is positioned adjacent the loading position (i.e., at the top of the wheel 50). As shown in phantom in FIG. 10, the reel motor actuator 172 is actuable under the control of the CPU 34 to move the reel motor 180 and drive hub 200 (along with the vertical plate 188 and L-bracket 216) toward the spindle assembly 71, 72, or 73 in the loading position such that the bullet nose dowel 208 extends into the steel bushing 220 in the brake hub 156. At the same time, the deflector pins 212 abut the brake plate 148, deflecting the compression springs 144 and disengaging the brake plate 148 from the ball bearings 164 (i.e., disengaging the detent mechanism). Also, the rubber ring 204 engages the machined face 224 of the brake hub 156, which couples the spindle assembly 71, 72, or 73 to the drive hub assembly 176 and permits the spindle 116 to be rotated by the reel motor 180. The reel drive assembly 168 therefore operates as a clutch.

Figure 11:
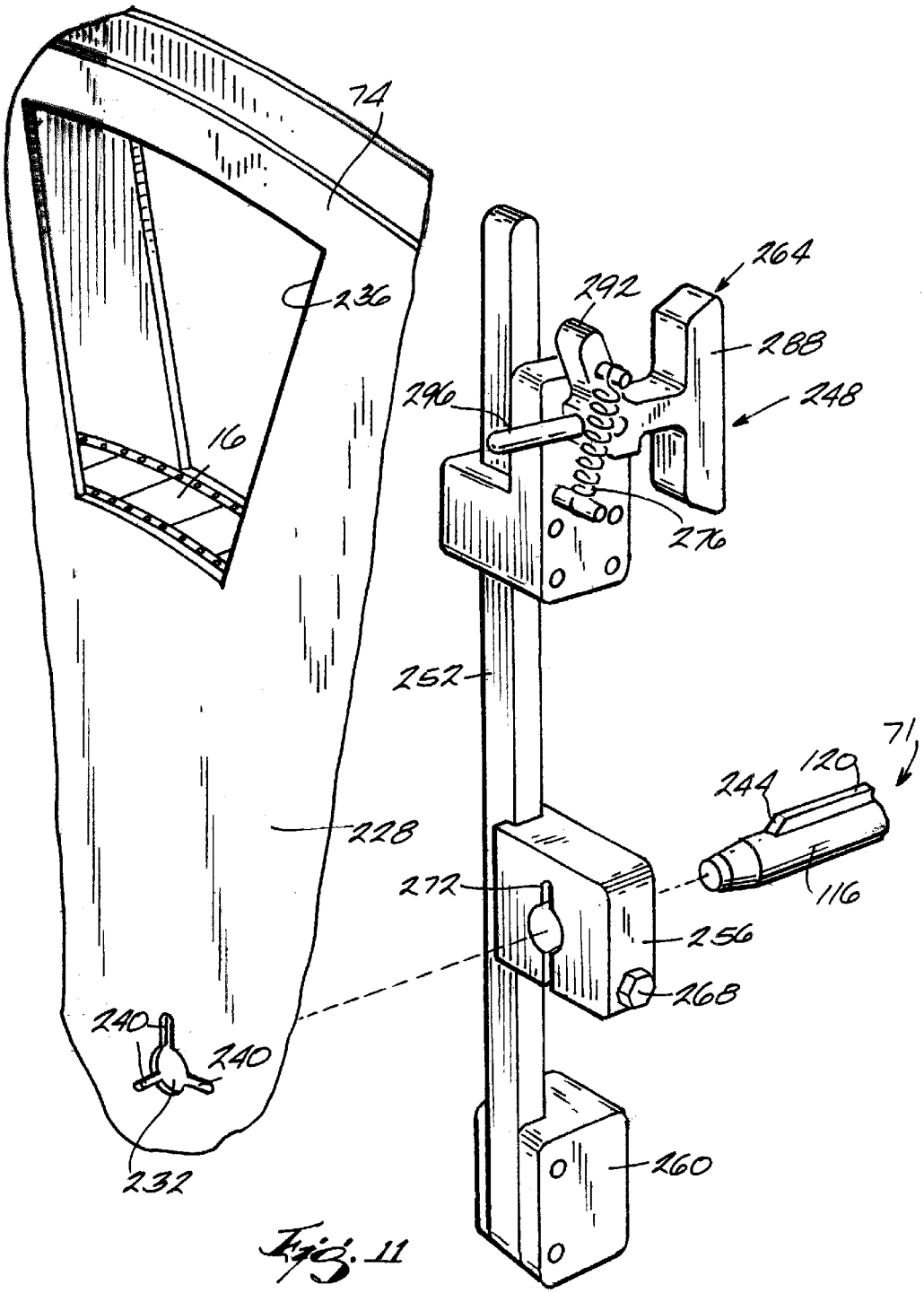
FIG. 11 is an exploded view of a spindle assembly, finger assembly, and reel of the MROM.
Figure 12:
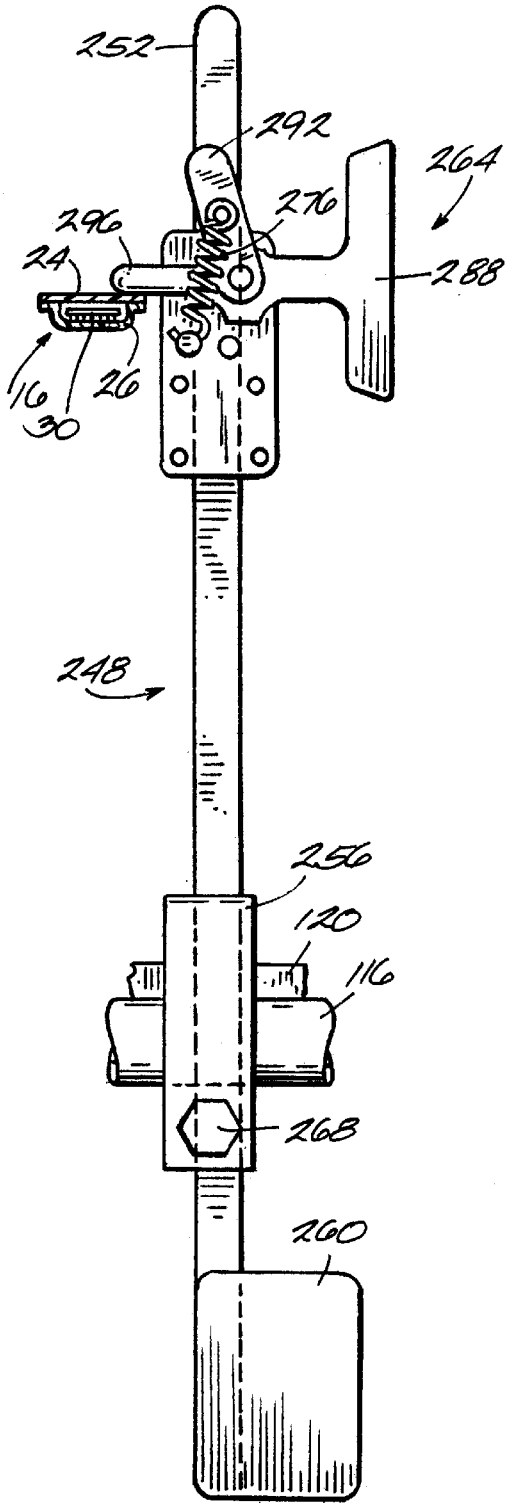
FIG. 12 is a side view of a finger assembly.
Figure 13:
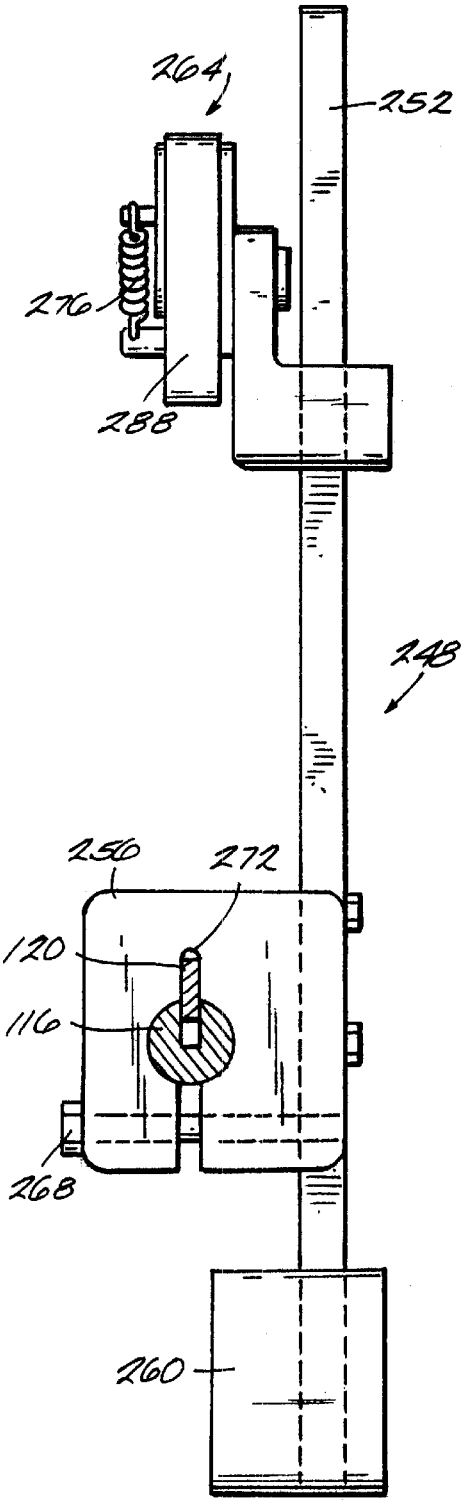
FIG. 13 is an end view of the finger assembly.

With reference to FIG. 11 one of the reels 74 will now be described, it being understood that the reels 74 are substantially identical to each other. The reel 74 includes a hub portion 228 and a hole 232 extending through the hub portion 228. The reel 74 also includes three windows 236. Three radial slots 240 are formed in the hub portion 228. The radial slots 240 extend along lines that substantially bisect the respective windows 236. The reel 74 may be loaded on a spindle assembly 71, 72, or 73 by simply sliding the spindle 116 through the hole 232 in the hub portion 228. The key mechanism 120 includes a nose 244 to facilitate sliding a reel 74 onto the spindle 116. The key 120 in the spindle 116 deflects if not aligned with one of the slots 240. The hub portion 228 may then be rotated until one of the slots 240 aligns with the key 120, at which time the spring-biased key 120 snaps into the slot 240. The key 120 couples the reel 74 to the spindle 116 to cause rotation of the reel 74 and spindle 116 together.

FIGS. 11–17 illustrate a finger assembly 248. Each spindle assembly 71, 72, 73 carries its own finger assembly 248, and it should be understood that the finger assemblies 248 are substantially identical to each other. The finger assembly 248 includes a proximity arm 252, and a clamp 256, counterweight 260, and latching finger 264 mounted to the proximity arm 252. The clamp 256 is affixed to the spindle 116 by turning a bolt 268 that closes the clamp 256 around the spindle 116. The clamp 256 ensures that the finger assembly 248 rotates with the spindle 116. A slot 272 in the clamp 256 is engaged by the key 120, which ensures that the latching finger 264 is aligned with a window 236 of the reel 74.

Figure 16:
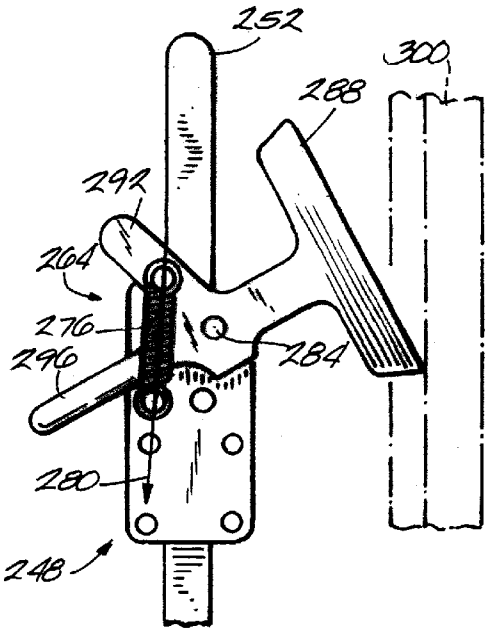
FIG. 16 is a side view of the finger assembly in a full down position.
Figure 14:
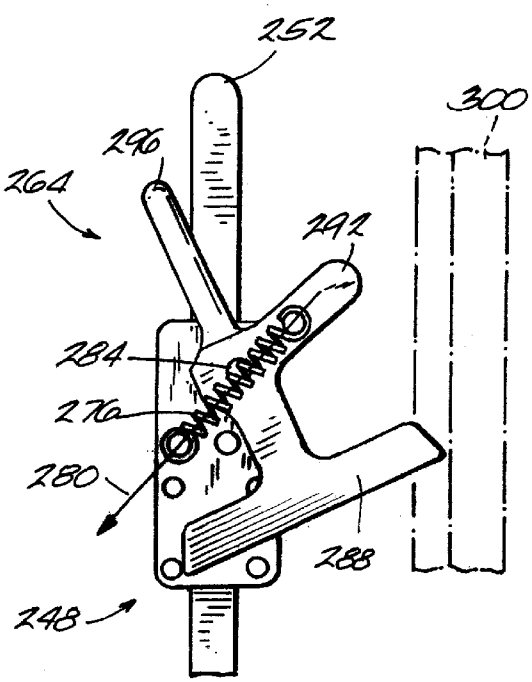
FIG. 14 is a side view of the finger assembly in a full up position.

The latching finger 264 is pivotal with respect to the proximity arm 252, and is movable between a full up position (FIG. 14), a middle or tape engaging position (FIG. 15), and a full down position (FIG. 16). A spring 276 or other suitable over-center biasing member is attached to the latching finger 264 and acts along a line of force 280. When the line of force 280 is below the pivot point 284 of the latching finger 264 (i.e., "under center"), the spring 276 biases the latching finger 264 toward the full up position (FIG. 14). When the line of force 280 is above the pivot point 284 of the latching finger 264 (i.e., "over center"), the spring 276 biases the latching finger 264 toward the middle and full down positions (FIGS. 15 and 16). The line of force 280 of the spring 276 crosses the pivot point 284 of the latching finger 264 (i.e., is "centered") when the latching finger 264 is positioned between the full up and middle positions. The latching finger 264 includes a stop member 288 having top and bottom ends, and also includes a manual actuator 292 to facilitate manually cocking the latching finger 264 to the full up position. The latching finger 264 also includes a nose or finger 296 extending through the window 236 in the reel 74 when the latching finger 264 is in the middle position.

A gate 300 is mounted to the base 46 near the loading position, and is mounted to a pneumatic cylinder 304 or other suitable gate actuator that is controlled by the CPU 34. The gate 300 is generally L-shaped and includes a trigger face portion 308 and a stopping wall 312. The top of the latching finger stop member 288 engages the stopping wall 312 of the gate 300 when the latching finger 264 is in the full up position, and the bottom of the latching finger stop member 288 engages the stopping wall 312 when the latching finger 264 is in the full down position. However, when the latching finger 264 is in the middle position, the stop member 288 is substantially vertical and does not interfere with the stopping wall 312.

Figure 17:
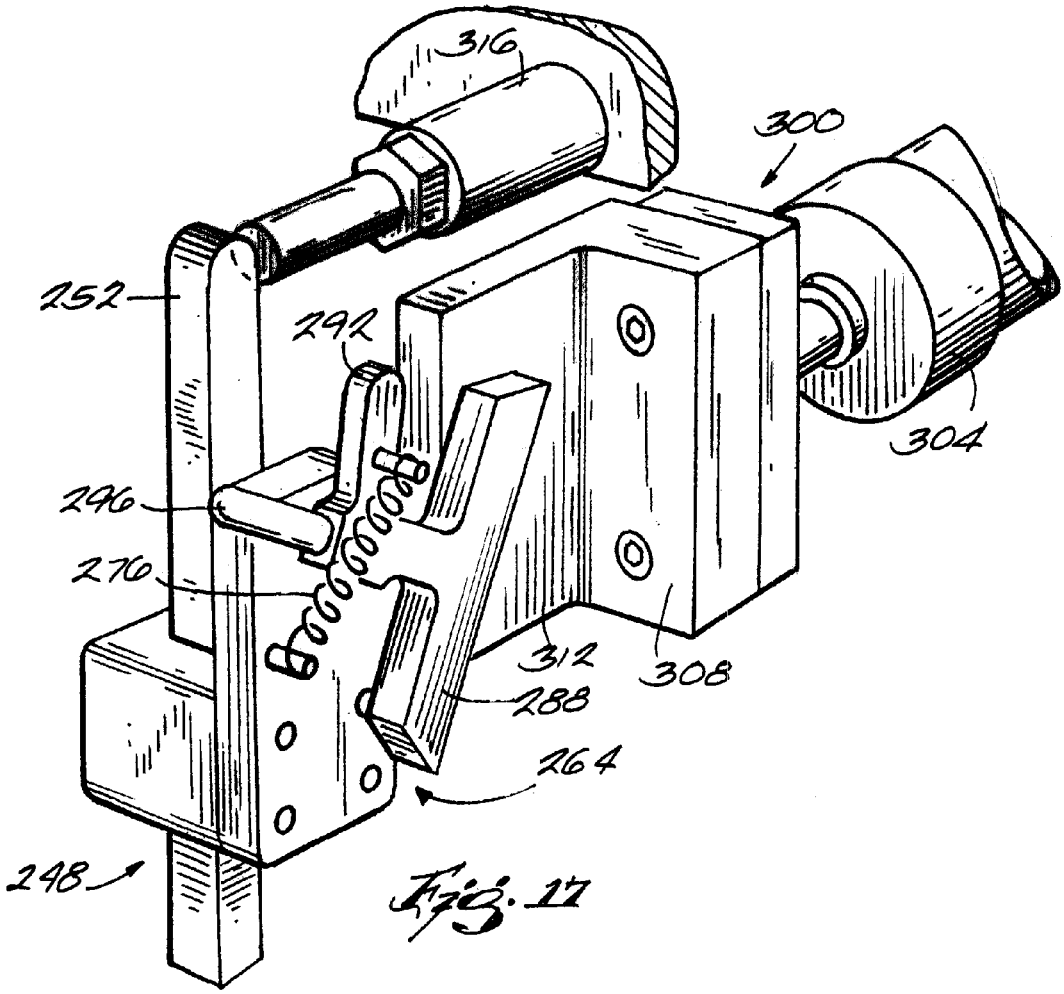
FIG. 17 is a perspective view of a finger assembly engaging the gate of the MROM.

With specific reference to FIG. 17, a proximity sensor 316 is mounted to the base 46 above the gate 300 near the loading position. When the stop member 288 of the latching finger 264 engages the side of the stopping wall 312, the proximity arm 252 of the finger assembly 248 is positioned in front of the proximity sensor 316. The proximity sensor 316 is interconnected with the CPU 34.

Figure 18:
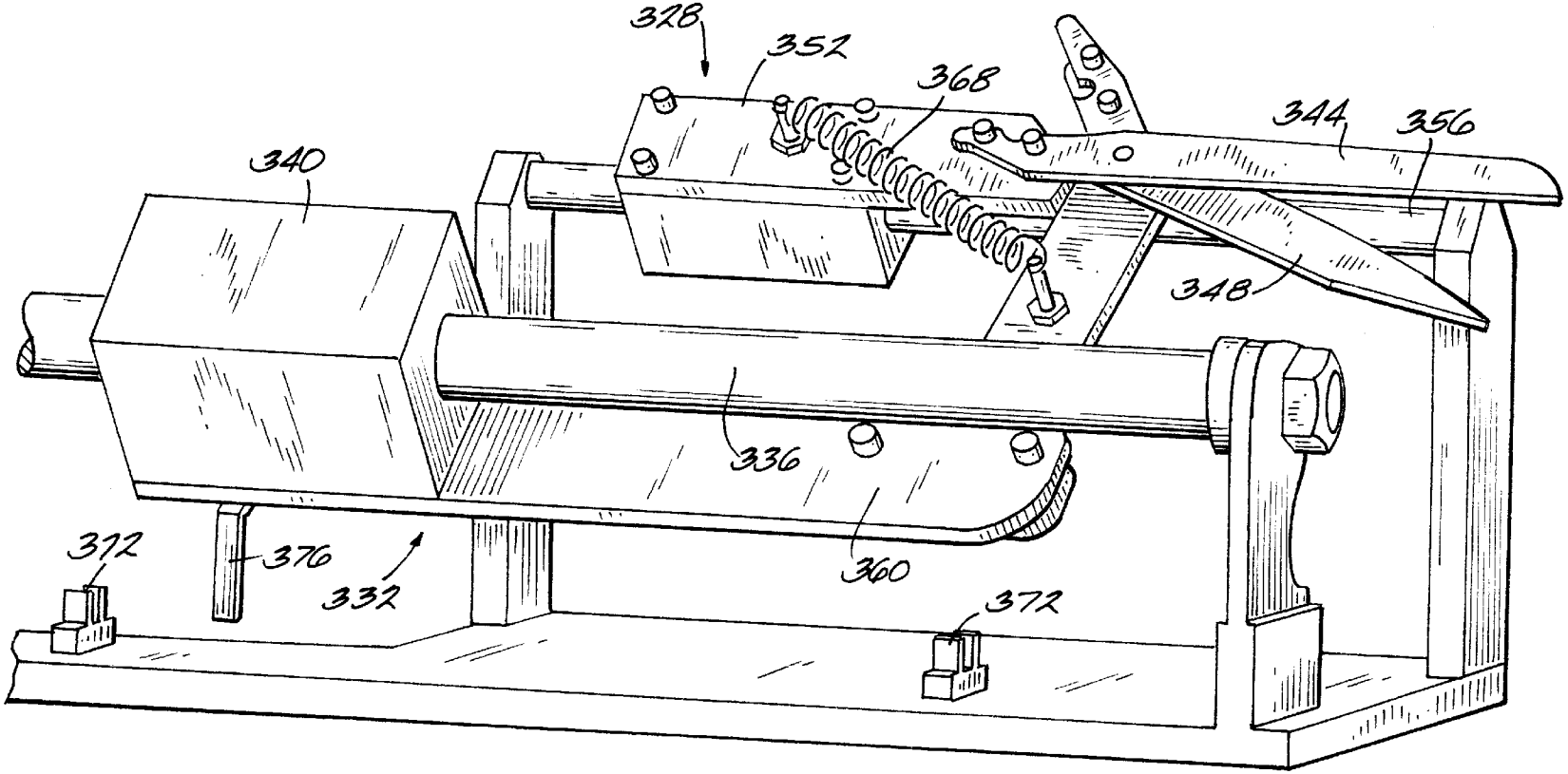
FIG. 18 is a perspective view of a tape cutting assembly of the MROM.
Figure 19:
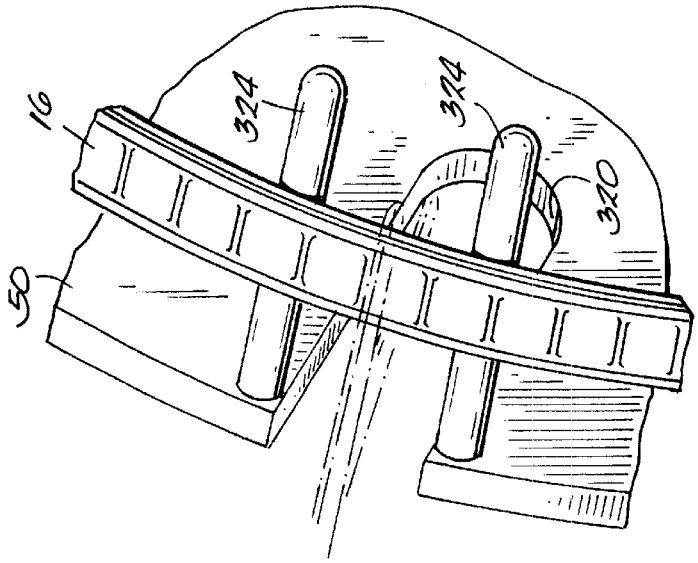
FIG. 19 is a view of the tape cutting assembly taken from a perspective different from FIG. 18.
Figure 19:
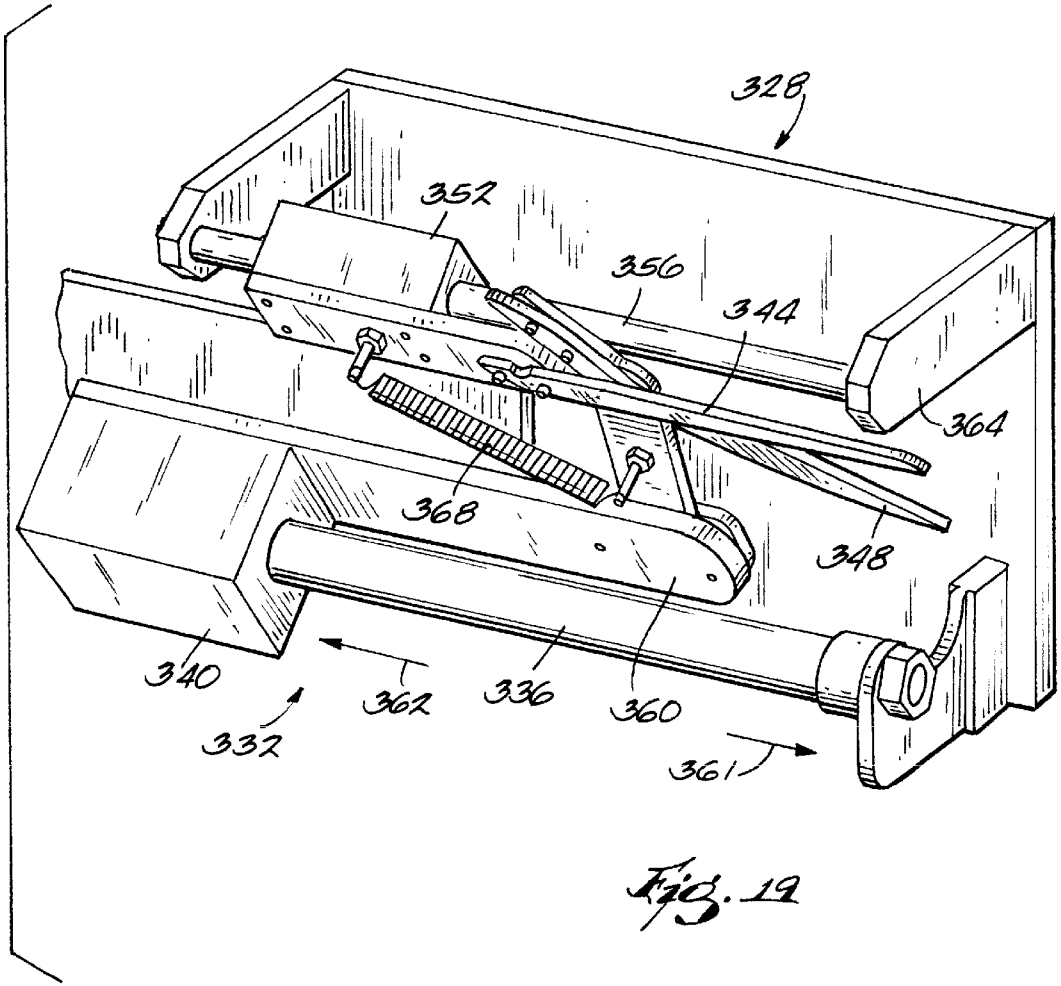

As seen in FIGS. 1 and 19, the wheel 50 includes three cutter slots 320 evenly spaced around its perimeter. A pair of tape guide posts 324 are mounted to the wheel 50 on opposite sides of each cutter slot 320. When one of the spindle assemblies 71, 72, 73 is in the loading position, one of the slots 320 is positioned in front of a tape cutting or scissors assembly 328 (FIGS. 18 and 19). As will be described in more detail below, the tape guide posts 324 support a span of tape 16 extending across the slot 320 in front of the tape cutting assembly 328 so that the tape cutting assembly 328 can cut the tape 16.

The tape cutting assembly 328 is best illustrated in FIGS. 18 and 19, and includes a double-acting magnetically-coupled pneumatic actuator 332 or another suitable actuator, which may be a pneumatic actuator or other appropriate actuator. The illustrated actuator 332 includes a cylinder 336 and a movable member 340 movable along the cylinder 336. The scissors assembly 328 also includes first and second blades 344, 348 that together act as a pair of scissors. The first blade 344 is mounted to a bearing block 352 that is slidable along a rod 356. The second blade 348 is pivotally mounted to an extension plate 360 that is mounted to the movable member 340 of the scissors actuator 332. The actuator 332 is activated by the CPU 34 to selectively move the movable member 340 along the length of the actuator cylinder 336 in forward and reverse directions 361, 362.

The second blade 348 is pivotally interconnected with the first blade 344 so that the two blades 344, 348 move together out of the slot 320 as the scissors actuator 332 moves the movable member 340 forward 361. When the bearing block 352 runs into a stop 364, the forward motion of the first blade 344 is stopped. The movable portion 340 of the scissors actuator 332, however, may continue its forward motion even after the first blade 344 has been stopped. Such forward motion causes the second blade 348 to pivot with respect to both the extension plate 360 and the first blade 344 in a conventional scissors cutting motion. The tape 16 spanning the slot 320 and supported by the tape guide posts 324 is thus cut by the blades 344, 348. A return spring 368 separates the blades 344, 348 as the scissors actuator 332 moves the movable portion 340 in the reverse direction 362 and retracts the blades 344, 348 through the slot 320. Interrupt switches 372 and a tab 376 on the movable portion 340 of the scissors actuator 332 are used to inform the CPU 34 when the movable portion 340 of the scissors actuator 332 is in the fully retracted and fully extended positions.

Figure 22:
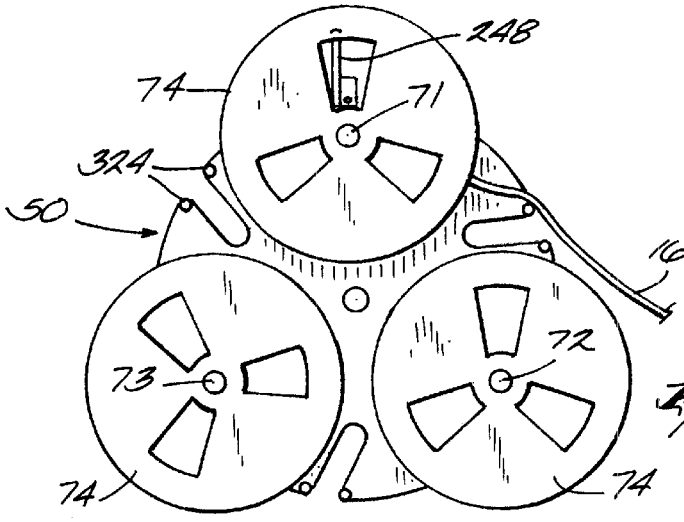
FIG. 22 is a front view of the wheel, with the first spindle assembly in the loading position and the reel on the first spindle assembly being loaded with output media.
Figure 23:
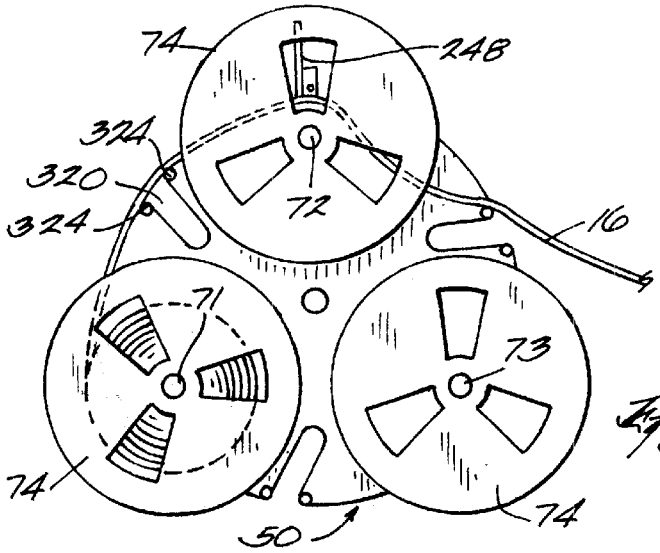
FIG. 23 is a front view of the wheel, with the second spindle assembly in the loading position, prior to the output media being cut.
Figure 24:
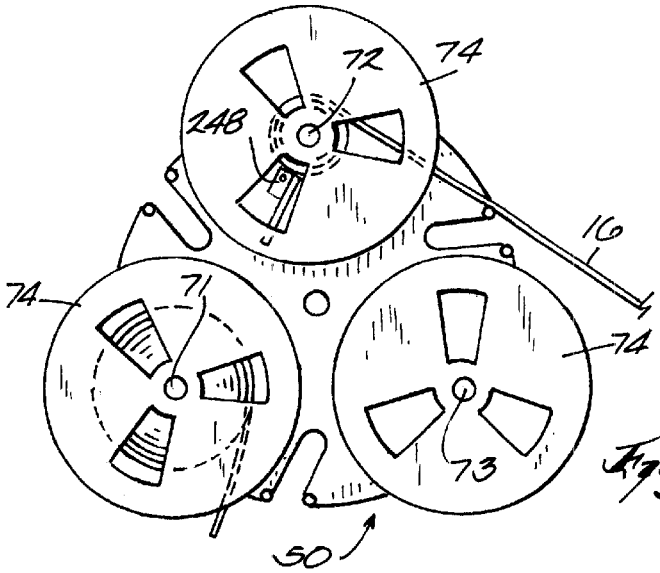
FIG. 24 is a view similar to that of FIG. 23, after the tape has been cut, and after the second spindle has been rotated to locate the finger on the end of the tail of output media.

In operation, as seen in FIG. 22–24, the first, second, and third spindles 71, 72, 73 are in the loading, on-deck, and change-out positions, respectively, and each spindle supports a reel 74. The latching fingers 264 on each of the three spindles 71, 72, 73 are manually moved to the full up position by pressing on the manual actuator 292. The output tape 16 from the taper machine 10 is positioned against the hub 228 of the reel 74 in the loading position, and the operator manually moves the latching finger 264 on the first spindle 71 to the middle position such that the nose 296 of the latching finger 264 traps the tape 16 against the hub 228.

The operator then pushes a start button 380 (FIG. 1), which causes the CPU 34 to begin operation of the MROM 38 and taper machine 10. The CPU 34 first checks the proximity sensor 316 to ensure that the proximity arm 252 is positioned there. If the proximity arm 252 is detected, the CPU 34 activates the reel drive assembly 168. The reel motor actuator 172 causes the drive hub assembly 176 to engage the brake hub 156, and causes the deflector pins 212 to deflect the brake plate 148 and disengage the detent mechanism 132. Once the drive hub assembly 176 and the brake hub 156 are coupled together by engagement of the rubber ring 204 and the machined face 224, the CPU 34 activates the reel motor 180 to rotate the first spindle 71 and wind the tape 16 onto the reel 74 in the loading position.

Figure 20:
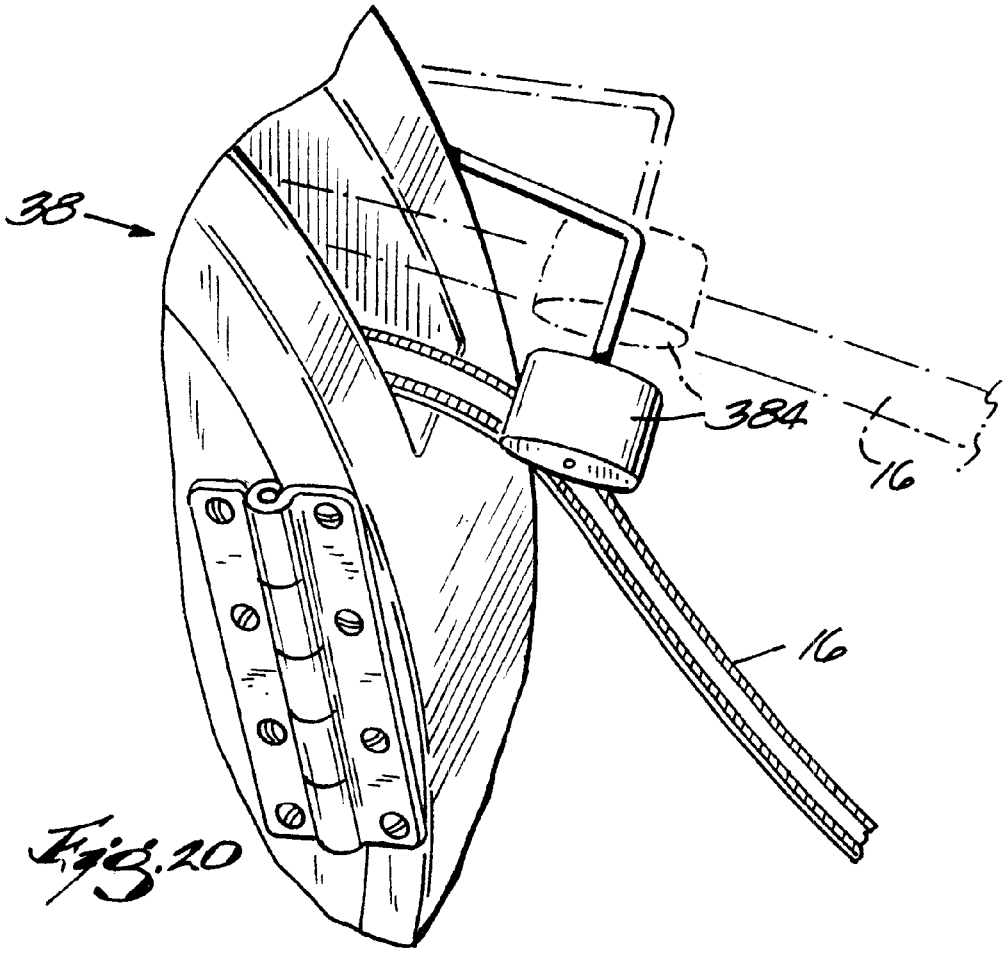
FIG. 20 is a front view of the dancer assembly of the MROM.
Figure 21:
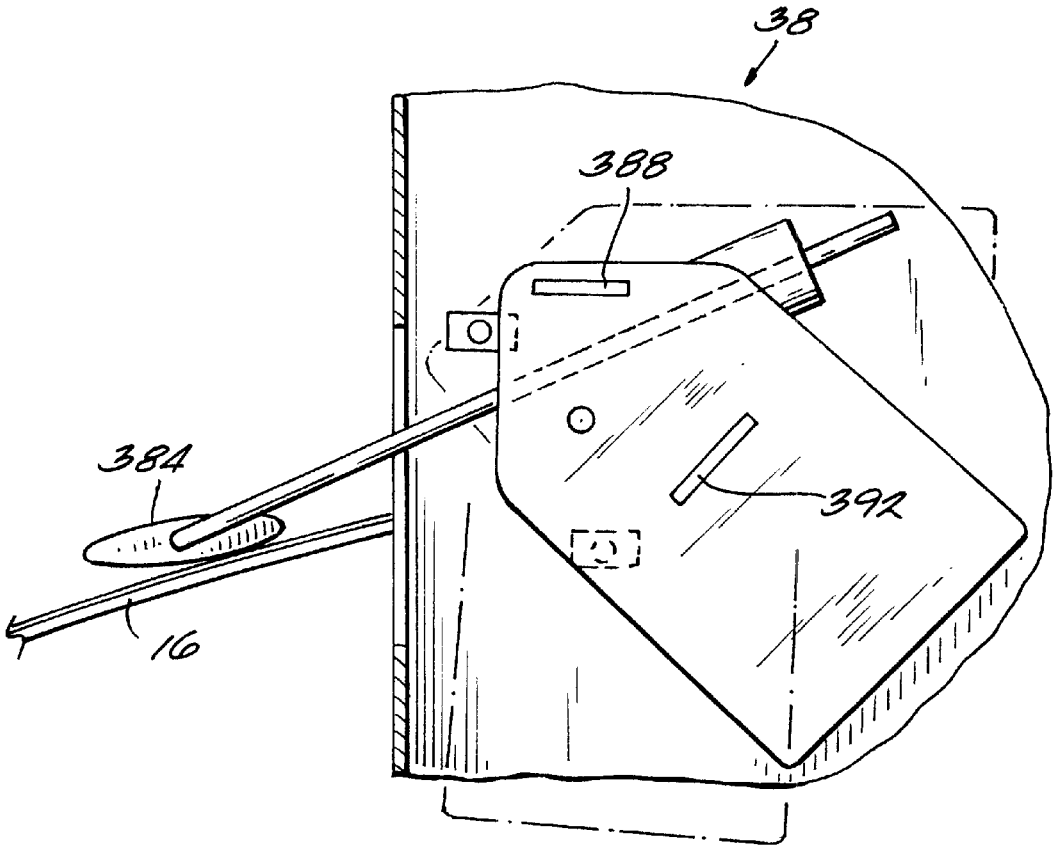
FIG. 21 is a rear view of the dancer assembly and the high and low limit switches of the MROM.

Turning to FIGS. 20 and 21, a dancer 384 rests on the length of tape 16 extending between the reel 74 and the taper machine 10. As the tape 16 becomes slack, the dancer 384 drops under its own weight. A lower limit switch 388 is activated when the dancer 384 falls below a predetermined height, which causes the CPU 34 to activate the reel motor 180. As the tape 16 is tightened due to the reel 74 taking up more tape 16 than the taper machine 10 is putting out, the dancer 384 reaches a predetermined height (shown in phantom in FIG. 20) and activates an upper limit switch 392. The CPU 34 shuts down the reel motor 180 in response to the dancer 384 activating the upper limit switch 392.

The CPU 34 keeps track of how much tape 16 has been fed out by the taper machine 10. The CPU 34 may be programmed to stop loading the reel 74 once a selected amount or "run" of tape 16 has been paid out. The CPU 34 factors in the pocket offset distance 78 in determining when the entire run of tape 16 has been loaded onto the reel 74 on the first spindle 71. Thus, the CPU 34 will not move the first spindle 71 from the loading position until the taper 10 has produced an entire run plus a length of tape equal to the pocket offset distance 78. At the end of a run, the CPU 34 also causes the taper machine 10 to pay out a length of empty pockets 26.

Once the desired amount of tape 16 is wound onto the reel 74 in the loading position, the CPU 34 activates the reel motor actuator 172 to retract the reel motor 180 and disengage the first spindle 71. The springs 144 of the detent mechanism 132 re-engage the detent mechanism once the reel motor 180 and deflector pins 212 are retracted. The first spindle 71 rotates under the influence of gravity until the ball bearings 164 fall into the detents 152 (i.e., the first spindle 71 rotates less than 120° because there are three detents 152). The detent mechanism 132 then resists further rotation of the first spindle 71 and unwinding of the tape 16 from the reel 74 on the first spindle 71.

The CPU 34 then actuates the wheel motor 82, and causes the wheel 50 to rotate in the forward direction. Once one of the detector pins 108 passes between the arms of the forked sensor 104, the CPU 34 incrementally steps the wheel motor 82 to cause small rotations of the output shaft 86 in the forward direction. The CPU 34 counts the number of steps required to pass the detector pin 108 entirely through the sensor 104, and then rotates the output shaft 86 in the reverse direction half of those steps to as closely as possible position the corresponding spindle (the second spindle 72 in this instance) in the loading position.

As seen in FIG. 23, the second spindle 72 is now in the loading position, the first spindle 71 is in the change-out position, and the third spindle 73 is in the on-deck position. Because the reels 74 on the first and second spindles 71, 72 are substantially co-planar, the tape 16 trailing from the reel 74 on the first spindle 71 drapes across the tape guide posts 324 and across the reel 74 on the second spindle 72. The portion of tape 16 extending between the first and second reels 71, 72 includes a length of empty tape compartments.

Once the CPU 34 has verified the presence of the proximity arm 252 in front of the proximity sensor 316, the CPU 34 activates the gate actuator 304, which moves the gate 300 toward the latching finger 264. The trigger face 308 of the gate 300 engages the top of the stop member 288 to urge the latching finger 364 toward the middle and full down positions. The nose 296 extends through the window 236 in the reel 74. The orientation of the window 236 in front of the finger 296 is assured by the engagement of the key 120 in the radial slots 240 of the hub 228.

Once the latching finger 264 is "over center," as discussed above, the spring 276 biases the latching finger 264 down against the hub 228 of the reel 74 in the loading position. The nose 296 therefore traps the tape 16 against the hub 228 of the reel 74 on the second spindle 72. Then the CPU 34 retracts the gate 300 by activating the gate actuator 304 in the opposite direction. The latching finger 264 is left in the middle position with the stop member 288 oriented substantially vertically. In this position, the latching finger 264 clears the stopping wall 312 of the gate 300 and the second spindle 72 may be rotated.

The CPU 34 then activates the cutting assembly 328, which extends the blades 344, 348 out of the slot 320 in the wheel 50. The blades 344, 348 cut the tape 16 between the first and second spindles 71, 72, leaving a tail of tape 16 hanging from both of the reels 74 on the first and second spindles 71, 72. The tails of tape 16 each include about half of the empty compartments discussed above. The CPU 34 then retracts the cutting assembly 328.

The CPU 34 is preprogrammed with the appropriate information (e.g., reel size and cutting position of the scissors) to determine the length of the tail of tape 16 hanging from the reel 74 on the second spindle 72. The CPU 34 activates the reel drive assembly 168 to rotate the second spindle 72, but does not activate the taper machine 10. This causes tension in the tape 16, and permits the nose 296 to slide along the tape 16 as the second spindle rotates 72. Once the nose 296 approaches the end of the tape 16 (as seen in FIG. 24), the CPU 34 stops the reel motor 180 and starts up the taper machine 10. The reel 74 is now ready to begin winding tape 16. Because the nose 296 is slid close to the end of the tape 16, the tape 16 is prevented from bending back on itself during the first rotation of the reel 74. The reel 74 on the second spindle 72 is loaded in a similar manner as described above for the first spindle 71.

As the reel 74 on the second spindle 72 is being loaded, the reel 74 on the first spindle 71 may be changed out with an empty reel 74. The full reel 74 on the first spindle 71 is merely slid off the first spindle 71, and the nose 296 slides out of the layers of tape 16 that have been wound around it. The operator then manually cocks the latching finger 264 to the full up position by pressing on the manual actuator 292.

Once the reel 74 is loaded, the CPU 34 rotates the second spindle 72 to the change-out position, and rotates the third spindle 73 into the loading position and the first spindle 71 into the on-deck position. The first spindle 71 should now have a new, empty reel 74 on it. The same finger engaging, cutting, and reel loading procedure just described above for the second spindle 72 is executed for the third spindle 73. The reel 74 on the second spindle 72 may be changed out for an empty one as described above for the first spindle 71.

It should be appreciated that the taper 10 and MROM 38 may be run virtually continuously, because an operator is afforded much time to change out the empty reels 74 in the change-out position. In this regard, an operator may work at several different tape machines 10 and MROM's 38 at once. Also, it will be appreciated that the MROM 38 described above may be modified to include only two spindles or more than three spindles depending on the application.

The CPU 34 is programmed with the appropriate logic to step through the operation of the MROM 38. The CPU 34 is also used to identify potential user errors. For example, if no reel 74 is present on the spindle assembly in the loading position, the latching finger 264 will rotate to its full down position (FIG. 16), and the bottom of the stop member 288 will engage the stopping wall 312 of the gate 300. The CPU 34 will sound an alarm if it there is resistance to rotation of the reel 74 in the loading position under these circumstances.

Additional interrupt sensors 396 (seen in FIG. 1) are also used to inform the CPU 34 of the status of the spindle assembly in the on-deck position. One of the sensors 396 identifies whether a reel 74 is present or not on the spindle assembly by detecting the presence or absence of the reel's hub 228. The other sensor 396 is directed below the hub 228 of the reel 74, and detects the presence of output media on the reel 74. If there is no reel 74 in the on-deck position, or if the reel 74 is full of output media, the CPU 34 will not permit the wheel 50 to rotate the spindle assembly into the loading position. Also, the CPU 34 may sound an alarm to notify the operator of the error.

What is claimed is:

1. A multiple output reel module for use with a device that produces a flexible output media, the module comprising:

a base;

first and second spindles supported by said base;

a reel mounted onto each of said first and second spindles for rotation therewith;

a mechanism for moving said first and second spindles into and out of a loading position;

an attachment mechanism attaching the output media to the one of said first and second spindles that is in said loading position;

a reel motor selectively rotating the one of said first and second spindles that is in said loading position, such that the output media is loaded onto the reel in the loading position;

wherein said mechanism for moving automatically moves said first spindle out of said loading position, and said second spindle into said loading position, once said reel on said first spindle is loaded with a selected amount of output media;

wherein said attachment mechanism automatically attaches the output media to the reel on said second spindle when said second spindle is in said loading position;

wherein said reel motor automatically loads the reel on said second spindle with output media after said output media is attached to said reel; and a reel motor actuator supporting said reel motor and actuable to move said reel motor into and out of engagement with the one of said first and second spindles that is in said loading position.

2. The module of claim 1, further comprising a reel wheel rotatably mounted to said base, said wheel rotatably supporting said first and second spindles, wherein said mechanism for moving includes a wheel motor operatively interconnected with said wheel to cause rotation of said wheel to selectively move said first and second spindles into and out of said loading position.

3. The module of claim 1, further comprising a CPU controlling the operation of said mechanism for moving, said reel motor, and said attachment mechanism.

4. The module of claim 1, further comprising a detent mechanism interconnected with each of said first and second spindles and selectively resisting rotation of said first and second spindles, respectively, wherein said reel motor actuator disengages said detent mechanism that is in said loading position when said reel motor actuator moves said reel motor into engagement.

5. The module of claim 1, wherein said attachment mechanism includes a finger that is selectively movable to interconnect the output media with the reel on the one of said first and second spindles that is in said loading position.

6. The module of claim 5, wherein said finger rotates in unison with said reel and spindle in said loading position.

7. The module of claim 5, wherein the output media winds around said reel in layers over said finger and wherein said finger is automatically removed from between said layers upon the removal of said reel from said spindle.

8. The module of claim 1, wherein said first and second spindles are configured such that the output media automatically extends over a portion of the reel on said second spindle when said first spindle is moved out of said loading position and said second spindle is moved into said loading position.

9. The module of claim 8, wherein the output media extends between said reels on said first and second spindles after said first spindle is moved out of said loading position and said second spindle is moved into said loading position, said module further comprising a cutting mechanism for cutting the extent of output media between the reels, said cutting mechanism being automatically operated.

10. A multiple output reel module for use with a device that produces a flexible output media, the module comprising:

a base;

first and second spindles supported by said base;

a reel mounted onto each of said first and second spindles for rotation therewith;

a mechanism for moving said first and second spindles into and out of a loading position;

an attachment mechanism attaching the output media to the one of said first and second spindles that is in said loading position;

a reel motor selectively rotating the one of said first and second spindles that is in said loading position, such that the output media is loaded onto the reel in the loading position;

wherein said mechanism for moving automatically moves said first spindle out of said loading position, and said second spindle into said loading position, once said reel on said first spindle is loaded with a selected amount of output media;

wherein said attachment mechanism automatically attaches the output media to the reel on said second spindle when said second spindle is in said loading position;

wherein said reel motor automatically loads the reel on said second spindle with output media after said output media is attached to said reel; and an over-center biasing mechanism acting on said attachment mechanism, said attachment mechanism being biased by said over-center biasing mechanism toward engagement with the output media when positioned over-center in a first direction, and said attachment mechanism being biased by said over-center biasing mechanism away from engagement with the output media when positioned over-center in a second opposite direction.

11. A multiple output reel module for use with a device that produces a flexible output media, the module comprising:

a base;

first and second spindles supported by said base;

a reel mounted onto each of said first and second spindles for rotation therewith;

a mechanism for moving said first and second spindles into and out of a loading position;

an attachment mechanism attaching the output media to the one of said first and second spindles that is in said loading position;

a reel motor selectively rotating the one of said first and second spindles that is in said loading position, such that the output media is loaded onto the reel in the loading position;

wherein said mechanism for moving automatically moves said first spindle out of said loading position, and said second spindle into said loading position, once said reel on said first spindle is loaded with a selected amount of output media;

wherein said attachment mechanism automatically attaches the output media to the reel on said second spindle when said second spindle is in said loading position;

wherein said reel motor automatically loads the reel on said second spindle with output media after said output media is attached to said reel; and a gate, wherein said attachment mechanism includes a stop member, said attachment mechanism being movable between an engaged position and a disengaged position, when in said engaged position, said attachment mechanism attaching the output media to said reel in said loading position and permitting rotation of said reel in said loading position, and when in said disengaged position, said attachment mechanism not engaging the output media and engaging said gate to resist rotation of said reel in said loading position.

12. A multiple output reel module for use with a device that produces a flexible output media, the module comprising:

a base;

first and second spindles supported by said base;

a reel mounted onto each of said first and second spindles for rotation therewith;

a mechanism for moving said first and second spindles into and out of a loading position;

an attachment mechanism attaching the output media to the one of said first and second spindles that is in said loading position;

a reel motor selectively rotating the one of said first and second spindles that is in said loading position, such that the output media is loaded onto the reel in the loading position;

wherein said mechanism for moving automatically moves said first spindle out of said loading position, and said second spindle into said loading position, once said reel on said first spindle is loaded with a selected amount of output media;

wherein said attachment mechanism automatically attaches the output media to the reel on said second spindle when said second spindle is in said loading position;

wherein said reel motor automatically loads the reel on said second spindle with output media after said output media is attached to said reel; and a gate having a trigger surface, and an actuator selectively moving said gate, wherein said actuator automatically moves said trigger surface of said gate into contact with said attachment mechanism to automatically attach the output media to said second reel.

13. A method for loading an output media onto a plurality of output reels supported by a plurality of spindles, the method comprising:

moving a first spindle and reel combination into a loading position;

attaching the output media to the first reel while the first spindle and reel combination are in the loading position; and then rotating the first spindle and reel assembly to load the output media onto the first reel; and then after the first reel is filled with output media, automatically moving the first reel and spindle out of the loading position, and moving a second reel and spindle combination into the loading position; and then automatically attaching the output media to the second reel in the loading position; and then automatically loading the second reel with output media by rotating the second spindle and reel combination; and providing a detent mechanism for each of the reel and spindle combinations, and selectively resisting rotation of each spindle with an associated detent mechanism when the reel on the spindle is not being loaded with output media.

14. The method of claim 13, wherein said act of moving a second reel and spindle combination into the loading position includes supporting the first and second spindles with a wheel, and rotating the wheel to move the first spindle out of the loading position and to move the second spindle into the loading position.

15. The method of claim 13, further comprising providing a CPU, wherein said acts of automatically moving, attaching, and loading are controlled by the CPU.

16. The method of claim 13, further comprising extending the output media from the first reel to the second reel after moving the first spindle out of the loading position and moving the second spindle into the loading position; and also further comprising cutting the output media between the first and second reels prior to loading the second reel.

17. The method of claim 13, wherein the act of attaching includes pinching the output media against a portion of the reel with a finger while the reel is in the loading position.

18. The method of claim 17, wherein the acts of loading the first and second reels include winding the output media around the reel in layers over the finger, the method further comprising removing the loaded reels from the associated spindles and sliding the finger out from under the layers of output media.

19. The method of claim 13, wherein said act of automatically moving the first and second reel and spindle combinations includes automatically extending the output media over a portion of the second reel.

* * * * *